US008048602B2

(12) United States Patent
Kubo

(10) Patent No.: US 8,048,602 B2
(45) Date of Patent: Nov. 1, 2011

(54) COLOR TONER, DEVELOPER, DEVELOPING DEVICE, AND IMAGE FORMING APPARATUS

(75) Inventor: Masahiko Kubo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 416 days.

(21) Appl. No.: 12/327,329

(22) Filed: Dec. 3, 2008

(65) Prior Publication Data

US 2009/0148191 A1 Jun. 11, 2009

(30) Foreign Application Priority Data

Dec. 6, 2007 (JP) ..... P2007-316340

(51) Int. Cl.
*G03G 9/08* (2006.01)

(52) U.S. Cl. ..... 430/108.6

(58) Field of Classification Search ..... 430/108.6
See application file for complete search history.

(56) References Cited

U.S. PATENT DOCUMENTS

| | | | | |
|---|---|---|---|---|
| 5,437,954 | A | 8/1995 | Saito | |
| 5,439,773 | A * | 8/1995 | Matsui et al. | 430/108.1 |
| 6,077,635 | A | 6/2000 | Okado et al. | |
| 6,203,962 | B1 * | 3/2001 | Itami et al. | 430/119.83 |
| 7,235,298 | B2 * | 6/2007 | Katusic et al. | 428/402 |
| 2001/0000743 | A1 | 5/2001 | Yuasa et al. | |
| 2001/0002305 | A1 | 5/2001 | Yuasa et al. | |
| 2002/0086229 | A1 | 7/2002 | Yuasa et al. | |
| 2004/0091803 | A1 | 5/2004 | Yamazaki et al. | |
| 2006/0177755 | A1 | 8/2006 | Toizumi et al. | |
| 2007/0020543 | A1 * | 1/2007 | Nakatani | 430/108.4 |
| 2007/0020552 | A1 | 1/2007 | Matsumoto et al. | |

FOREIGN PATENT DOCUMENTS

| | | | |
|---|---|---|---|
| CN | 1664708 | A | 9/2005 |
| CN | 1818802 | A | 8/2006 |
| CN | 101004564 | A | 7/2007 |
| JP | 1-273056 | A | 10/1989 |
| JP | 04-000452 | | 1/1992 |
| JP | 04-124678 | | 4/1992 |
| JP | 06-242628 | | 9/1994 |
| JP | 09-325512 | | 12/1997 |
| JP | 11-174731 | | 7/1999 |
| JP | 2001-066829 | | 3/2001 |
| JP | 2003-57872 | A | 2/2003 |
| JP | 2003-107787 | A | 4/2003 |
| JP | 2004-037756 | A | 2/2004 |
| JP | 2007-121482 | A | 5/2007 |

* cited by examiner

*Primary Examiner* — Janis L Dote
(74) *Attorney, Agent, or Firm* — Nixon & Vanderhye P.C.

(57) ABSTRACT

A color toner, a developer, a developing device for performing development by using the developer and an image forming apparatus having the developing device are provided. A developer, which contains a color toner formed by adding zinc oxide particles externally to the surfaces of toner base particles containing binder resin and colorant, in which the average primary particle size of zinc oxide particles falls in a range of 10 nm or more and 50 nm or less, the average particle size of primary-particle aggregates of zinc oxide particles is 0.3 μm or less and the zinc oxide particle is made of zinc oxide doped with aluminum, is charged in a developer tank of a developing device of an image forming apparatus for image formation.

5 Claims, 2 Drawing Sheets

COLOR TONER, DEVELOPER, DEVELOPING DEVICE, AND IMAGE FORMING APPARATUS

CROSS-REFERENCE TO RELATED APPLICATION

This application claims priority to Japanese Patent Application No. 2007-316340, which was filed on Dec. 6, 2007, the contents of which are incorporated herein by reference in its entirety.

BACKGROUND OF THE INVENTION

1. Field of the Invention

The present invention relates to a color toner, a developer and a developing device, and an image forming apparatus having the developing device.

2. Description of the Related Art

An image forming apparatus employing an electrophotographic system for forming images by means of electrophotography is capable of forming high-quality images with ease, and is thus widely used for example as a copier, a printer, a facsimile machine, and a multifunctional peripheral. In particular, an image forming apparatus that enables full-color printing is springing into wide use.

An electrophotographic image forming apparatus (hereafter referred to simply as "image forming apparatus") includes, for example, a photoreceptor, a charging section, an exposure section, a developing section, a transfer section, and a fixing section. The image forming apparatus performs a charging process, an exposure process, a development process, a transfer process, and a fixing process with use of the photoreceptor and the aforementioned sections thereby to form images on a recoding medium.

In the charging process, the surface of the photoreceptor is uniformly charged by the charging section. In the exposure process, the photoreceptor in a charged state is exposed to light by the exposure section to form an electrostatic latent image on the surface of the photoreceptor. In the development process, charge-bearing toner is caused to adhere to the electrostatic latent image formed on the surface of the photoreceptor by the developing section thereby to form a visual image on the surface of the photoreceptor. In the transfer process, the visual image formed on the surface of the photoreceptor is transferred onto a recording medium such as paper or a sheet by the transfer section. Note that, in full-color printing operation, there may be a case where the visual image formed on the surface of the photoreceptor is transferred onto an intermediate transfer medium first, and is then transferred onto a recording medium via the intermediate transfer medium. In the fixing process, the transferred visual image is fixed onto a recording medium under application of for example heat and pressure by the fixing section. The development process includes a charge application step to apply electric charge to toner contained in a developer.

In the image forming apparatus, full-color printing can be achieved by using, as a developer, toners of the three primary colors, to be specific, toners of three colors: an yellow-color toner; a magenta-color toner; and a cyan-color toner, or toners of four colors: the aforementioned three color toners and a black-color toner. The charging process, the exposure process, the development process, and the transfer process are carried out for the toner of each color on an individual basis, whereupon a visual image consisting of the toners of a plurality of colors is formed on a surface of a recording medium. Then, in the fixing process, after the plural-color toners are melted and mixed so as to achieve color blending, the visual image is fixed onto the recording medium. In this way, a full-color image can be formed.

As the developer for forming the visual image, there are two types: a two-component developer composed of carrier and toner; and a one-component developer composed solely of toner. In the charge application step, in the case of using the two-component developer, it is possible to apply electric charge to the toner by producing friction between the toner and the carrier acting as a charge applying portion. On the other hand, in the case of using the one-component developer, it is possible to apply electric charge to the toner by bringing the toner into pressure-contact with a layer-thickness regulating member acting as a charge applying portion.

In the charge application step, smooth charge movement between toner particles and smooth charge movement between the toner and the charge applying portion as well, and stable control of the amount of charge applied to the toner are of importance to form a high-quality image. In particular, a color toner which contains an organic pigment as a colorant exhibits higher resistance than a black toner does, and therefore charge movement cannot be readily produced therein. Accordingly, stable control of the amount of charge applied to the toner is especially important if the color toner is employed.

As a technique to achieve stable control of the amount of charge applied to the toner, Japanese Unexamined Patent Publication JP-A 4-452 (13992) discloses external addition of titanium oxide subjected to surface treatment with metal salt of fatty acid to toner. In this case, it is possible to improve the stability of charging effected by friction between the toner and carrier and thereby shorten a charging rise time for supplied toner.

Moreover, Japanese Unexamined Patent Publication JP A 4-124678 (1992) discloses a technique to obtain a toner in which charge exchange between the toner and carrier is made smoothly, charging can be effected at high speed, and a distribution of the amount of charge is narrow by external addition of zinc-oxide fine particles having a volume specific resistance of $10^0$ to $10^8$ Ωcm and an average primary particle size of 100 to 500 mμm to toner.

Further, Japanese Unexamined Patent Publication JP-A 9-325512 (1997) discloses a technique to suppress variation in the amount of charge applied to toner, to form high-quality images with ease, and to ensure high transfer efficiency by external addition of zinc oxide having an average primary particle size of 0.01 to 0.1 μm and a specific surface area of 25 to 200 $m^2/g$ to toner as an external additive.

As has already been described, it is possible to control the amount of charge applied to toner with stability by using, as an external additive, titanium oxide or zinc oxide in the form of electrically conductive particles. However, the toner disclosed in JP-A 4-452 is externally added with titanium oxide whose refractive index is higher than that of zinc oxide. In this case, as compared with a case where it is externally added with zinc oxide, the transparency of a fixed toner layer becomes lower, which leads to poor color reproducibility.

As for the toner disclosed in JP-A 4-124678, although zinc oxide whose refractive index is lower than that of titanium oxide is used as an external additive, the average primary particle size of the external additive is as large as 100 to 500 mμm. In this case, as compared with a case where zinc oxide having an average primary particle size of less than 100 mμm is used as an external additive, the transparency of a fixed toner layer becomes lower.

The toner disclosed in JP-A 9-325512 pays no regard to the size of a primary-particle aggregate of zinc oxide used as an external additive. Since zinc oxide for use has a large specific surface area, the aggregation of particles tends to occur easily. Therefore, depending on the size of a primary-particle aggregate of zinc oxide, a decline in transparency may occur.

SUMMARY OF THE INVENTION

An object of the invention is to provide a color toner capable of preventing transparency deterioration in a fixed toner layer resulting from external addition of an external additive, providing excellent color reproducibility, and forming images having uniform image density while maintaining the image density for a longer period of time from the start of operation, and provide a developer, a developing device for performing development by using the developer and an image forming apparatus having the developing device.

The invention provides a color toner comprising:

toner base particles containing binder resin and colorant, surfaces of which are externally added with zinc oxide particles, the zinc oxide particles being such that an average particle size of their primary particles falls in a range of 10 nm or more and 50 nm or less, an average particle size of their primary-particle aggregates is 0.3 μm or less, and the zinc oxide particle is made of zinc oxide doped with aluminum.

According to the invention, the color toner is formed by adding zinc oxide particles externally to the surfaces of the toner base particle containing binder resin and colorant. The average primary particle size of the zinc oxide particles falls in a range of 10 nm or more and 50 nm or less. The average particle size of the primary-particle aggregates of the zinc oxide particles is 0.3 μm or less.

A difference between the refractive index of the zinc oxide: 1.95 and the refractive index of the binder resin: 1.5 to 1.6 is smaller than a difference between the refractive index of another external additive, for example, titanium oxide: 2.5 to 2.7 and the refractive index of the binder resin. Accordingly, in the case of using the zinc oxide particles as an external additive, it is possible to keep the proportion of light which is reflected from the surfaces of zinc oxide particles lower as compared with the case of using another external additive.

When the average particle size of the primary-particle aggregates of the zinc oxide particles exceeds 0.3 μm, even if the zinc oxide particles is used as an external additive, the transparency of a fixed toner layer is decreased. By setting the average particle size of the primary-particle aggregates of the zinc oxide particles to be less than or equal to 0.3 μm, it is possible to maintain the transparency of a fixed toner layer.

When the average particle size of the primary particles of the zinc oxide particles is less than 10 nm, the zinc oxide particles tend to clump together easily. This makes it impossible to control the average particle size of the primary-particle aggregates of the zinc oxide particles to be less than or equal to 0.3 μm, with the result that the transparency of a fixed toner layer is decreased. On the other hand, when the average primary particle seize of the zinc oxide particles exceeds 50 nm, the specific surface area of the primary-particle aggregate of the zinc oxide particles is less than the specific surface area of a primary-particle aggregate of zinc oxide particles which have an average particle size of 50 nm or less. This makes it impossible to cover the surface of the toner base particle with the zinc oxide particles efficiently. Therefore, the surface resistance cannot be adjusted properly and thus the amount of charge applied to the toner cannot be controlled with stability, in consequence whereof there results significant variation in image density in the course of image formation. By adjusting the average particle size of the primary particles of the zinc oxide particles to fall in a range of 10 nm or more and 50 nm or less, it is possible to set the average particle size of the primary-particle aggregates of the zinc oxide particles that is added externally to the surface of the toner base particle to be less than or equal to 0.3 μm. In consequence, the transparency of a fixed toner layer can be maintained. Moreover, since the amount of charge applied to the toner can be controlled with stability, it is possible to form images having uniform image density with stability.

Accordingly, it is possible to realize a color toner characterized by preventing transparency deterioration in a fixed toner layer resulting from external addition of an external additive, by providing excellent color reproducibility, and by enabling formation of images having uniform image density while maintaining the image density for a longer period of time from the start of operation.

Moreover, the zinc oxide particle is made of zinc oxide doped with aluminum (hereafter referred to as "aluminum-doped zinc oxide"). By subjecting zinc oxide particles to aluminum doping, it is possible to control the volume resistivity of the zinc oxide particles. Moreover, even if zinc oxide is doped with aluminum, the resultant aluminum-doped zinc oxide suffers little from transparency deterioration relatively to aluminum doping-free zinc oxide. Accordingly, transparency deterioration in a fixed toner layer resulting from external addition of particles of aluminum-doped zinc oxide to the toner base particle can be suppressed.

In the invention, it is preferable that volume resistivity of the zinc oxide particles falls in a range of 500 Ωcm or more and $10^7$ Ωcm or less.

According to the invention, the volume resistivity of the zinc oxide particles falls in a range of 500 Ωcm or more and $10^7$ Ωcm or less. When the volume resistivity of the zinc oxide particles is less than 500 Ωcm, the amount of charge applied to the toner becomes so small that fogging and scattering of toner may be caused. When the volume resistivity of the zinc oxide particles exceeds $10^7$ Ωcm, neither smooth charge movement between toner particles nor smooth charge movement between the toner and carrier can be achieved. In consequence, the amount of charge applied to the toner becomes unstable, which may lead to significant variation in, for example, image density, in the course of image formation. In the case where the volume resistivity of the zinc oxide particles takes on an appropriate value of 500 Ωcm or more and $10^7$ Ωcm or less, charge movement between toner particles, and charge movement between the toner and a charge applying portion, for example, charge movement between the toner and carrier or a layer-thickness regulating member, can be achieved smoothly. This makes it possible to stabilize the amount of charge applied to the toner, and thereby prevent occurrence of fogging and toner scattering. Accordingly, images having uniform image density can be produced more stably.

In the invention, it is preferable that a specific surface area of the zinc oxide particles falls in a range of 30 $m^2/g$ or more and 100 $m^2/g$ or less.

According to the invention, the zinc oxide particles which are added externally to the toner base particle has a specific surface area of 30 $m^2/g$ or more and 100 $m^2/g$ or less. When the specific surface area of the zinc oxide particles is less than 30 $m^2/g$, the surface of the toner base particle cannot be covered with the zinc oxide particles sufficiently. In this case, it may be impossible to adjust the surface resistance of the toner properly. When the specific surface area of the zinc oxide particles exceeds 100 $m^2/g$, zinc oxide particles tend to clump together easily. In this case, it may be impossible to control the average particle size of the primary-particle aggregates of the zinc oxide particles to be less than or equal to 0.3

μm. Therefore, the transparency of a fixed toner layer may be decreased. By setting the specific surface area of the zinc oxide particles to fall in a range of 30 $m^2/g$ or more and 100 $m^2/g$ or less, it is possible to cover the surface of the toner base particle with the zinc oxide particles sufficiently, and thereby adjust the resistance on the toner surface with stability. Moreover, it is possible to set the average particle size of the primary-particle aggregates of the zinc oxide particles which are added externally to the surface of the toner to be less than or equal to 0.3 μm, and thereby maintain the transparency of a fixed toner layer.

In the invention, it is preferable that a content of the zinc oxide particles falls in a range of 0.05 parts by weight or more and 3.0 parts by weight or less with respect to 100 parts by weight of the toner base particles.

According to the invention, the amount of the zinc oxide particles to be added to the toner base particle falls kin a range of 0.05 parts by weight or more and 3.0 parts by weight or less with respect to 100 parts by weight of the toner base particles. When the additive amount of the zinc oxide particles is less than 0.05 parts by weight, the surface of the toner base particle cannot be covered with the zinc oxide particles sufficiently. Therefore, even with the external addition of the zinc oxide particles, it may be impossible to adjust the surface resistance of the toner properly. When the additive amount of the zinc oxide particles exceeds 3.0 parts by weight, the amount of the zinc oxide particles added externally to the surface of the toner base particle becomes so large that the proportion of light reflected from the zinc oxide particles is increased. This may lead to a decline in the transparency of a fixed toner layer. By setting the amount of the zinc oxide particles to be added to the toner base particle to fall in a range of 0.05 parts by weight or more and 3.0 parts by weight or less with respect to 100 parts by weight of the toner base particles, it is possible to cover the surface of the toner base particle with the zinc oxide particles sufficiently, and thereby adjust the surface resistance of the toner more stably. Moreover, it is possible to maintain the transparency of a fixed toner layer.

In the invention, it is preferable that a volume average particle size of the toner base particles falls in a range of 4.0 μm or more and 8.0 μm or less.

According to the invention, the volume average particle size of the toner base particles falls in a range of 4.0 μm or more and 8.0 μm or less. When the volume average particle size of the toner base particles is less than 4.0 μm, the amount of charge on a per-toner-particle basis becomes too small. When the volume average particle size of the toner base particles exceeds 8.0 μm, the thin-line reproducibility is deteriorated. By setting the volume average particle size of the toner base particles to fall in a range of 4.0 μm or more and 8.0 μm or less, it is possible to control the amount of charge applied to the toner stably even further. Moreover, by virtue of excellent thin-line reproducibility, high-quality images can be produced more stably.

The invention provides a developer containing the color toner mentioned above.

According to the invention, the developer contains the color toner of the invention. In this case, as compared with a case where an external additive other than that specified in the invention is externally added, it is possible to obtain a developer in which deterioration in the transparency of a fixed toner layer can be suppressed. Moreover, it is also possible to obtain a developer in which the amount of charge applied to the toner can be controlled with stability.

The invention provides a developing device which forms a toner image by developing a latent image formed on an image bearing member with use of the developer mentioned above.

According to the invention, the developing device effects development by using the color toner of the invention. The color toner of the invention is capable of maintaining the transparency of a fixed toner layer even with the external addition of an external additive, and thus enables formation of toner images having uniform image density with stability. Moreover, the color toner of the invention is capable of controlling the amount of charge and preventing occurrence of fogging and toner scattering, and thus enables formation of good toner images with stability.

The invention provides an image forming apparatus comprising:

an image bearing member on which is formed a latent image;

a latent-image forming section for forming a latent image on the image bearing member; and the developing device mentioned above.

According to the invention, the image forming apparatus is realized with the provision of the developing device of the invention that allows formation of a toner image on the image hearing member without causing fogging as described hereinabove. By forming images with use of such an image forming apparatus, it is possible to form images having uniform image density with stability for a longer period of time from the start of operation, as well as to attain excellent color reproducibility in formed images.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
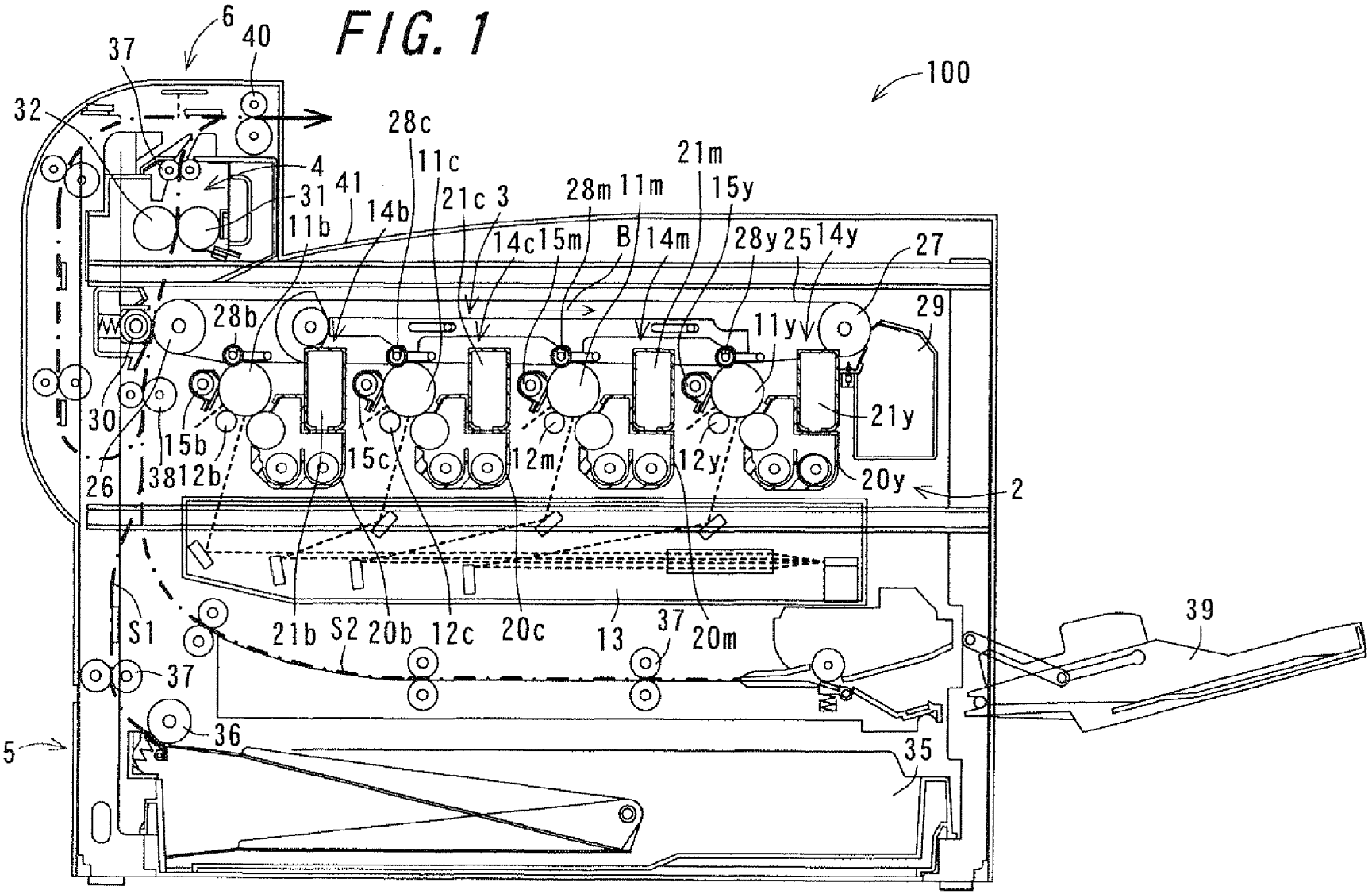
FIG. 1 is a schematic view showing the constitution of an image forming apparatus in accordance with one embodiment of the invention.

Now referring to the drawings, preferred embodiments of the invention will be described in detail.

A color toner implemented by way of one embodiment of the invention (hereafter also referred to simply as "toner") is obtained by adding zinc oxide particles externally to a surface of a toner base particle containing binder resin and a colorant. As for zinc oxide particles in use, an average particle size of primary particles (hereafter referred to as "average primary particle size") falls in a range of 10 nm or more and 50 nm or less, and an average particle size of primary-particle aggregates is 0.3 μm or less.

A difference between the refractive index of zinc oxide: 1.95 and the refractive index of binder resin: 1.0 to 1.6 is smaller than a difference between the refractive index of another external additive, for example, titanium oxide: 2.5 to 2.7 and the refractive index of binder resin. Accordingly, in the case of using zinc oxide particles as an external additive, it is possible to keep the proportion of light which is reflected from the surfaces of zinc oxide particles lower as compared with the case of using another external additive.

When the average particle size of primary-particle aggregates of zinc oxide particles exceeds 0.3 μm, even if zinc oxide particles are used as an external additive, the transparency of a fixed toner layer is decreased. By setting the average particle size of primary-particle aggregates of zinc oxide particles to be smaller than or equal to 0.3 μm, more preferably, smaller than or equal to 0.2 μm, it is possible to maintain the transparency of a fixed toner layer.

When the average primary particle size of zinc oxide particles is less than 10 nm, zinc oxide particles tend to clump together easily. This makes it impossible to control the average particle size of primary-particle aggregates of zinc oxide particles to be smaller than or equal to 0.3 μm. Therefore, even if zinc oxide particles are used as an external additive, the transparency of a fixed toner layer is decreased. On the other hand, When the average primary particle size of zinc oxide particles exceeds 50 nm, the specific surface area of a primary-particle aggregate of zinc oxide particles is smaller than the specific surface area of a primary-particle aggregate of zinc oxide particles which have an average particle size of 50 nm or less. This makes it impossible to cover the surface of the toner base particle with zinc oxide particles efficiently. Therefore, the surface resistance cannot be adjusted properly and thus the amount of charge applied to the toner cannot be controlled with stability, in consequence whereof there results significant variation in image density in the course of image formation. By adjusting the primary particle size of zinc oxide particles to fall in a range of 10 nm or more and 50 nm or less, it is possible to set the average particle size of primary-particle aggregates of zinc oxide particles which are added externally to the surface of the toner to be smaller than or equal to 0.3 μm. In consequence, the transparency of a fixed toner layer can be maintained. Moreover, since the amount of charge applied to the toner can be controlled with stability, it is possible to form images having uniform image density with stability.

Accordingly, it is possible to realize a color toner characterized by preventing transparency deterioration in a fixed toner layer resulting from external addition of an external additive, by providing excellent color reproducibility, and by enabling formation of images having uniform image density while maintaining the image density for a longer period of time from the start of operation.

The measurement of the average primary particle size of zinc oxide particles can be conducted by means of particle-size distribution measurement equipment that utilizes dynamic light scattering, for example, DLS-800 (product name) manufactured by Otsuka Electronics Co., Ltd. or COULTER N4 (product name) manufactured by Coulter Electronics Inc. However, since the secondary aggregation of hydrophobically treated particles cannot be dissociated readily, it is desirable to derive the average primary particle size directly by analyzing a photograph image obtained by means of a scanning electron microscope (SEW) or a transmission electron microscope (TEM).

It is preferable that zinc oxide particles which are added externally to the toner base particle have a volume resistivity of 500 Ωcm or more and 107 Ωcm or less. When the volume resistivity of zinc oxide particles is less than 500 Ωcm, the amount of charge applied to the toner becomes so small that fogging and scattering of toner may be caused. When the volume resistivity of zinc oxide particles exceeds $10^7$ Ωcm, neither smooth charge movement between toner particles nor smooth charge movement between the toner and carrier can be achieved. In consequence, the amount of charge applied to the toner becomes unstable, which may lead to significant variation in, for example, image density, in the course of image formation. In the case where the volume resistivity of zinc oxide particles sakes on an appropriate value of 500 Ωcm or more and $10^7$ Ωcm or less, charge movement between toner particles, and charge movement between the toner and a charge applying portion, for example, charge movement between the toner and carrier or a layer-thickness regulating member, can be achieved smoothly. This makes it possible to stabilize the amount of charge applied to the toner, and thereby prevent occurrence of fogging and toner scattering. Accordingly, images having uniform image density can be produced more stably.

The volume resistivity of zinc oxide particles can be derived from the following expression by means of dielectric loss measurement equipment, for example, DIELECTRIC LOSS MEASUREMENT SYSTEM TYPE TR-10C (product name) manufactured by Ando Electric Co., Ltd.

$$R'=10A/(Gx\cdot Tx)$$

$$Gx=\text{RATIO value}\times(R'-Ro)$$

In the expression, R" represents the volume resistivity of zinc oxide particles; A represents an effective electrode area in an electrode for solid body (approximately 2.83 (0.952 n) $cm^2$; Gx represents conductance; Tx represents a mean value of the thickness of a compact of zinc oxide molded into a tablet used as a measurement sample, which is obtained by measuring tablet thickness at five positions: the center and four circumferential points of the tablet; RATIO value represents a constant ($1\times10^{-9}$) determined for each measurement frequency on an individual basis at the time of measurement; R' represents conductance obtained after a lapse of 15 minutes from the start of application of voltage to the measurement sample; and Ro represents conductance obtained at the time of conducting zero-balance operation using the measurement sample.

It is preferable that zinc oxide particles which are added externally to the toner base particle have a specific surface area of 30 $m^2/g$ or more and 100 $m^2/g$ or less. When the specific surface area of zinc oxide particles is less than 30 $m^2/g$, the surface of the toner base particle cannot be covered with zinc oxide particles sufficiently. In this case, it may be impossible to adjust the surface resistance of the toner properly. When the specific surface area of zinc oxide particles exceeds 100 $m^2/g$, zinc oxide particles tend to clump together easily. In this case, it may be impossible to control the average particle size of primary-particle aggregates of zinc oxide particles to be smaller than or equal to 0.3 μm. Therefore, the transparency of a fixed toner layer may be decreased. By setting the specific surface area of zinc oxide particles to fall in a range of 30 $m^2/g$ or more and 100 $m^2/g$ or less, it is possible to cover the surface of the toner base particle with zinc oxide sufficiently, and thereby adjust the resistance on the toner surface with stability. Moreover, it is possible to set the average particle size of primary particle aggregates of zinc oxide particles which are added externally to the surface of the toner to be smaller than or equal to 0.3 μm, and thereby maintain the transparency of a fixed toner layer.

In this embodiment, the specific surface area of zinc oxide particles is measured by the BET three-point method. That is, a plot slope A is obtained on the basis of the amount of nitrogen adsorbed at three relative pressure points, and a specific surface area value is derived from a BET equation. The measurement of the specific surface area of zinc oxide particles is conducted by means of BET SPECIFIC SURFACE AREA ANALYZER GEMINI 2360 (manufactured by Shimadzu Corporation), for example.

It is preferable that the amount of zinc oxide particles to be added to the toner base particle falls in a range of 0.05 parts by weight or more and 3.0 parts by weight or less with respect to 100 parts by weight of the toner base particles. When the additive amount of zinc oxide particles is less than 0.05 parts by weight, the surface of the toner base particle cannot be covered with zinc oxide particles sufficiently. Therefore, even with the external addition of zinc oxide particles, it may be impossible to adjust the surface resistance of the toner properly. When the additive amount of zinc oxide particles exceeds 3.0 parts by weight, the amount of zinc oxide particles added externally to the surface of the toner base particle becomes so large that the proportion of light reflected from zinc oxide particles is increased. This may lead to a decline in the transparency of a fixed toner layer. By setting the amount of zinc oxide particles to be added to the toner base particle to fall in a range of 0.05 parts by weight or more and 3.0 parts by weight or less with respect to 100 parts by weight of the toner base particles, it is possible to cover the surface of the toner base particle with zinc oxide particles sufficiently, and thereby adjust the surface resistance of the toner with stability. Moreover, it is possible to maintain the transparency of a fixed toner layer.

Moreover, it is preferable that the zinc oxide particle is made of zinc oxide doped with aluminum (hereafter referred to as "aluminum-doped zinc oxide"). By subjecting zinc oxide to aluminum doping, it is possible to control the volume resistivity of zinc oxide particles. Moreover, even if zinc oxide is doped with aluminum, the resultant aluminum-doped zinc oxide suffers little from transparency deterioration relatively to aluminum doping-free zinc oxide. Accordingly, transparency deterioration in a fixed toner layer resulting from external addition of zinc oxide particles to the toner base particle can be suppressed.

For example, a thermal decomposition technique disclosed in Japanese Unexamined Patent Publication JP-A 2005-534607 can be adopted as a method for subjecting zinc oxide to aluminum doping. According to the thermal decomposition technique disclosed in JP-A 2005-534607, at first, zinc powder is evaporated in the presence of flame of air and/or oxygen and combustion gas, preferably hydrogen. The resultant zinc vapor, moisture vapor obtained as a product of flame reaction, and, in some cases, a reaction mixture composed of an excess of combustion gas, are cooled down to supply aerosol containing at least one doping component, namely aluminum oxide. Then, the reaction mixture is subjected to oxidation with air and/or oxygen. The oxidized reaction product is cooled down to a temperature of lower than 400° C. with the addition of cooled gas, whereupon zinc oxide is doped with aluminum.

In this embodiment, zinc oxide particles which are added externally to the toner base particle can be used in combination with another external additive. As another external additive, particles that have no adverse effect on the transparency of a fixed toner layer, for example, silica particles may be used. The combination use of silica is desirable, because it makes it possible to control toner flowability. In order to prevent the transparency of a fixed toner layer from being adversely affected, it is desirable to use silica having a refractive index of 1.45 or higher and 1.75 or lower and an average particle size of 7 nm or more and 300 nm or less.

It is preferable that the additive amount of external additives including zinc oxide particles and another external additive falls in a range of 0.1 parts by weight or more and 10 parts by weight or lesser more preferably, 2.0 parts by weight or more and less than 4.0 parts by weight, with respect to 100 parts by weight of the toner base particles.

Moreover, according to the invention, it is preferable that the volume average particle size of the toner base particles falls in a range of 4.0 μm or more and 8.0 μm or less. When the volume average particle size of the toner base particles is less than 4.0 μm, the amount of charge on a per-toner-particle basis becomes too small. When the volume average particle size of the toner base particles exceeds 8.0 μm, the thin-line reproducibility is deteriorated. By setting the volume average particle size of the toner base particles to fall in a range of 4.0 μm or more and 8.0 μm or less, it is possible to control the amount of charge applied to the toner stably even further. Moreover, by virtue of excellent thin-line reproducibility, high-quality images can be produced more stably.

There is no particular limitation to the selection of binder resin for use in the toner base particles, and thus known binder resin can be used. The examples thereof include polyester resin, styrenic resin such as polystyrene and styrene-acrylic acid ester copolymer resin, acrylic resin such as polymethyl methacrylate, polyolefin-based resin such as polyethylene, polyurethane, and epoxy resin. It is also possible to use, as the binder resin, a resin obtained by blending a release agent into a raw-material monomer mixture and then subjecting the resultant mixture to polymerization reaction. The binder resin materials may be used each alone, or two or more of them may be used in combination. Among the aforementioned materials, polyester resin is particularly desirable for use as binder resin. By using polyester resin as binder resin, it is possible to obtain a toner that is high in durability and is excellent in transparency.

Polyester resin can be obtained by a known method. To be specific, it can be obtained by subjecting a polyhydric alcohol component and a multivalent carboxylic acid component to polycondensation. The examples of the polyhydric alcohol component include dihydric alcohol such as ethylene glycol, 1,2-propylene glycol, 1,3-propylene glycol, 1,4-butanediol, 2,3-butanediol, diethylene glycol, triethylene glycol, 1,5-pentanediol, 1,6-hexanediol, neopentylene glycol, 1,4-cyclohexane dimethanol, dipropylene glycol, polyethylene glycol, polypropylene glycol, bisphenol A, hydrogenated bisphenol A, and alkylene oxide adducts of bisphenol A such as polyoxyethylene bisphenol A and polyoxypropylene bisphenol A.

In order for polymers to be non-linearized (cross-linked) to an extent that would prevent formation of tetrahydrofuran insoluble matters, polyhydric alcohol of trivalency or above can be used. The examples of an alcohol component of trivalency or above include glycerin, sorbitol, 1,2,3,6-hexanetetraol, 1,4-sorbitan, pentaerythritol, 1,2,4-butanetriol, 1,2,5-pentanetriol, 2-methylpropanetriol, 2-methyl-1,2,4-butanetriol, trimethylolethane, trimethylolpropane, and 1,3,5-trihydroxymethylbenzene. Those polyhydric alcohols may be used each alone, or two or more of them may be used in combination.

Examples of the multivalent carboxylic acid component include aliphatic polycarboxylic acids, aromatic polycarboxylic acids, alicyclic polycarboxylic acids, and the anhydrides thereof. Examples of aliphatic polycarboxylic acids include oxalic acid, malonic acid, succinic acid, adipic acid, suberic acid, azelaic acid, sebacic acid, maleic acid, maleic acid anhydride, fumaric acids and pimelic acid. Examples of aromatic polycarboxylic acids include glutaric acid, phthalic acid, isophthalic acid, terephthalic acid, phthalic acid anhydride, trimellitic acid anhydride, pyromellitic acid, and naphthalene dicarboxylic acid. Examples of alicyclic polycarboxylic acids include 1,4-cyclohexane dicarboxylic acid and 1,3-cyclohexane dicarboxylic acid. Those multivalent carboxylic acid components may be used each alone, or two or more of them may be used in combination.

Examples of a colorant which is contained in the toner base particles include a colorant for yellow toner, a colorant for magenta toner, and a colorant for cyan toner.

Examples of the colorant for yellow toner include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 180, C.I. Pigment Yellow 93, C.I. Pigment Yellow 74, and C.I. Pigment Yellow 185, inorganic pigments such as yellow iron oxide and yellow ocher, nitro dyes such as C.I. Acid Yellow 1, and oil soluble dyes such as C.I. Solvent Yellow 2, C.I. Solvent Yellow 6, C.I. Solvent Yellow 14, C.I. Solvent Yellow 15, C.I. Solvent Yellow 19, and C.I. Solvent Yellow 21, which are classified according to Color Index.

Examples of the colorant for magenta toner include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10, and C.I. Disperse Red 15, which are classified according to Color Index.

Examples of the colorant for cyan toner include C.I. Pigment Blue 15, C.I. Pigment Blue 16, C.I. Solvent Blue 55, C.I. Solvent Blue 70, C.I. Direct Blue 25, and C.I. Direct Blue 86, which are classified according to Color Index.

Other than the aforementioned pigments, for example, vermilion pigments and green pigments may be used. Those colorant materials may be used each alone, or two or more of them may be used in combination. Moreover, two or more of same hue-based colorant materials may be used in combination, and different hue-based colorant materials may be used each alone, or two or more of them may be used in combination.

It is preferable that the colorant is used in the form of master batch. For example, the master batch of the colorant can be manufactured by kneading a molten material of synthetic resin and the colorant. As the synthetic resin, a resin of the same kind as the binder resin for use in the toner or a resin which exhibits excellent compatibility with respect to the binder resin for use in the toner may be used. Although the usage ratio between the synthetic resin and the colorant is not particularly restricted, it is preferable that the colorant amount falls in a range of 30 parts by weight or more and 100 parts or less by weight with respect to 100 parts by weight of the synthetic resin. The master batch is subjected to granulation so as to have a particle size of 2 to 3 mm, for example.

Although the amount of the colorant contained in the toner base particles is not particularly restricted, preferably it should fall in a range of 2 parts by weight or more and 20 parts by weight or less with respect to 100 parts by weight of the binder resin. In the case of using the master batch, the amount of the master batch to be used should preferably be so adjusted that the content of the colorant in the color toner of the invention falls within the aforementioned range. By using the colorant in a content falling within the aforementioned range, it is possible to produce satisfactory images that have sufficient image density, exhibit excellent coloration, and offer high image quality.

In the toner of the invention, the toner base particles may contain, in addition to the binder resin and the colorant, another toner constituent component, for example, a release agent and a charge control agent.

There is no particular limitation to the selection of the release agent for use in the invention, and thus known ones can be used. Examples of a release agent having low polarity include a petroleum wax such as a paraffin wax and its derivatives and a microcrystalline wax and its derivatives, and a hydrocarbon-based synthetic wax such as a Fischer-Tropsch wax and its derivatives, a polyolefin wax and its derivatives, a low-molecular weight polypropylene wax and its derivatives, and a polyolefin based polymer wax and its derivatives. Moreover, Examples of a release agent having high polarity include a carnauba wax and its derivatives, and an ester-based wax. Although the amount of the release agent to be used is not particularly restricted and can be selected in a wide adequate range, preferably it should fall in a range of 0.2 parts by weight or more and 20 parts by weight or less with respect to 100 parts by weight of the binder resin. When the content of the release agent exceeds 20 parts by weight, there arises a problem that a phenomenon such as filming on the photoreceptor and spent on carrier tends to occur. When the content of the release agent is less than 0.2 parts by weight, there arises a problem that it is impossible to make full use of the capabilities of the release agent.

As the charge control agent, the ones for positive charge control and the ones for negative charge control can be used. Examples of charge control agents for positive charge control include a basic dye, quaternary ammonium salt, quaternary phosphonium salt, aminopyrine, a pyrimidine compound, a multinuclear polyamino compound, aminosilane, a triphenylmethane derivative, guanidine salt, and amidine salt. Examples of charge control agents for negative charge control include a metallized azo compound, an azo complex dye, naphthene acid metallic salt, metallic complex and metallic salt of salicylic acid and its derivatives, a boron compound, long-chain alkylcarboxylic acid salt, and resin acid soap. Examples of metal of metallic complex and metallic salt of salicylic acid and its derivatives include chrome, zinc, and zirconium.

It is preferable that the content of the charge control agent falls in a range of 0.5 parts by weight or more and 5 parts by weight or less, more preferably, 0.5 parts by weight or more and 3 parts by weight or less, with respect to 100 parts by weight of the binder resin. When the content of the charge control agent exceeds 5 parts by weight with respect to 100 parts by weight of the binder resin, carrier may be contaminated by the charge control agent exposed at the surface of the toner base particle. This leads to an undesirable decrease in the amount of charge that may eventually cause occurrence of toner scattering. When the content of the charge control agent is less than 0.5 parts by weight with respect to 100 parts by weight of the binder resin, it is impossible to impart adequate charging characteristics to the toner. In the case where the toner base particles have a charge-control agent content of 0.5 parts by weight or more and 5 parts by weight or less with respect to 100 parts by weight of the binder resin, the amount of charge applied to the toner under friction can be kept in a desired range.

There is no particular limitation to the method for manufacturing the toner base particles of the invention, and thus the toner base particles can be obtained by any of known methods.

For example, the toner base particles of the invention can be manufactured by a melt-kneading pulverization method. According to the melt-kneading pulverization method, predetermined amounts of the binder resin, the colorant, and, as another toner constituent components, the release agent, and the charge control agent, and so forth are subjected to a dry-mixing process. The resultant mixture is melt-kneaded to obtain a melt-kneaded product. The melt-kneaded product is cooled down to be solidified, and the resultant solid product is mechanically pulverized. In this way, the toner base particles can be manufactured. Examples of a mixer used for the dry-mixing process include Henschel type mixing apparatuses such as HENSCHEL MIXER (product name) manufactured by Mitsui Mining Co., Ltd., SUPERMIXER (product name) manufactured by Kawata MFG Co., Ltd., and MECHANOMILL (product name) manufactured by Okada Seiko Co., Ltd., ANGMILL (product name) manufactured by Hosokawa Micron Corporation, HYBRIDIZATION SYSTEM (product name) manufactured by Nara Machinery Co., Ltd., and COSMOSYSTEM (product name) manufactured by Kawasaki Heavy Industries, Ltd. In the kneading process, the mixture is agitated under application of heat at a temperature which is higher than or equal to the melting temperature of the binder resin but lower than or equal to the melting temperature of the binder resin +100° C. (normally ca. 80 to 200° C., preferably 100 to 150° C.). As the kneading machine for use, typical ones such for example as a twin-screw extruder, a three-roll mill, and a laboplast mill may be used. The specific examples of typical kneading machines include single- or twin-screw extruders such as TEM-100B (product name) manufactured by Toshiba Machine Co., Ltd. and PCM-65/87 (product name) manufactured by Ikegai, Ltd., and kneaders of open roll type such as KNEADEX (product name) manufactured by Mitsui Mining Co., Ltd. Among them, kneaders of open roll type are preferable for use. Examples of the pulverizer for use in pulverization of the solid product obtained by cooling the melt-kneaded product include a cutter mill, a feather mill, a jet mill, and a cutting mill. For example, the solid product is roughly pulverized by a cutter mill, and is thereafter pulverized by a jet mill. In this way, it is possible to obtain a toner having a desired volume average particle size. Moreover, following the completion of the jet-mill pulverization, particle sizing may be conducted by means of a classifier.

In this embodiment, the melting temperature of the binder resin is a temperature obtained by the following measurement method. By using a differential scanning calorimeter: DSC 220 (product name) manufactured by Seiko Instruments Inc., a binder resin portion of 1 g is heated from 20° C. to 150° C. at a temperature elevation rate of 10° C./min, and is thereafter cooled rapidly from 150° C. to 20° C. This operation is repeated twice to measure a DSC curve. As the melting point of the binder resin, there is obtained a temperature at a vertex of the endothermic peak of the DSC curve corresponding to fusion measured in the second run.

Moreover, the toner base particles of the invention may be manufactured also by the following method: for example, the solid product of the melt-kneaded product is coarsely pulverized, and the resultant coarsely-pulverized product is formed into an aqueous slurry. The aqueous slurry is treated with a high-pressure homogenizer to obtain fine particles. The resultant fine particles are heated in an aqueous medium so that they are coagulated and melted, whereupon the toner base particles are produced. For example, the solid product of the melt-kneaded product is coarsely pulverized by means of a jet mill, a hand mill, or otherwise. Through the coarsely pulverizing process, coarse powder having a particle size of about 100 μm to 3 mm is obtained. The coarse powder is dispersed in water to prepare an aqueous slurry. In preparation for water dispersion of the coarse powder, for example, an adequate amount of a dispersant such as sodium dodecylbenzenesulfonate is dissolved in water. By doing so, it is possible to obtain an aqueous slurry in which the coarse powder are dispersed evenly. The aqueous slurry thereby obtained is treated with a high-pressure homogenizer to shape the coarse powder contained in the aqueous slurry into fine particles, whereupon arm aqueous slurry containing fine particles having a volume average particle size of approximately 0.4 to 1.0 μm can be obtained. This aqueous slurry is heated to cause the fine particles to clump together and eventually melt to combine together. In this way, toner base particles can be obtained. The volume average particle size of the toner base particles can be set to a desired value by, for examples appropriately selecting a heating temperature and a duration of heating time for the fine particle-containing aqueous slurry. The heating temperature is selected appropriately in a range of temperatures that are higher than or equal to the softening point of the binder resin but lower than the decomposition temperature of the binder resin. Under the condition that the heating time duration remains the same, the higher is the heating temperature, the larger is the volume average particle size of the toner obtained.

As the high-pressure homogenizer, commercially available ones are known. The examples thereof include high-pressure homogenizers of chamber type such as MICROFLUIDIZER (product name) manufactured by Microfluidics International Corporation, NANOMIZER (product name) manufactured by NANOMIZER Inc., and ULTIMIZER (product name) manufactured by Sugino Machine Limited, and HIGH-PRESSURE HOMOGENIZER (product name) manufactured by Rannie Corporation, HIGH-PRESSURE HOMOGENIZER (product name) manufactured by Sanmaru Machinery Co., LTD., HIGH-PRESSURE HOMOGENIZER (product name) manufactured by Izumi Fond Machinery Co., LTD., and NANO3000 (product name) manufactured by Beryu Co., Ltd.

The whole or part of the produced toner base particles may be subjected to spheronizatton treatment. As the means for conducting spheronization, there are an impact-force spheronizing apparatus and a hot-air spheronizing apparatus. As the impact-force spheronizing apparatus, commercially available ones, for example, FACULTY (product name) manufactured by Hosokawa Micron Corporation and HYBRIDIZATION SYSTEM (product name) manufactured by Nara Machinery Co., Ltd. may be used. As the hot-air spheronizing apparatus, commercially available ones, for example, a surface modification machine: METEORAINBOW (product name) manufactured by Nippon Pneumatic Mfg. Co., Ltd. may be used.

The toner base particles produced in the above-described manner are externally added with zinc oxide particles. The color toner embodying the invention is obtained in the form of collective entity of the toner particles externally added with zinc oxide particles. As the method for adding zinc oxide particles externally to the toner base particle, there is a method of mixing the toner base particles and zinc oxide particles by means of a Henschel type mixing apparatus such as HENSCHEL MIXER (product name; manufactured by Mitsui Mining Co., Ltd., SUPERMIXER (product name) manufactured by Kawata MFG Co. Ltd., and MECHANOMILL (product name) manufactured by Okada Seiko Co., Ltd.

The toner of the invention manufactured as above can be used as one-component developer without change and can also be mixed with a carrier to be used in form of two-component developer.

It is preferable that the developer contains the color toner of the invention. In this case, in contrast to the case of adding an external additive other than those as specified in the invention, it is possible to obtain a developer in which deterioration in the transparency of a fixed toner layer is suppressed. Moreover, it is possible to obtain a developer in which the amount of charge applied to the toner can be controlled with stability.

For the carrier, magnetic particles can be used. Specific examples of the magnetic particles include metals such as iron, ferrite, and magnetite; and alloys composed of the metals just cited and metals such as aluminum or lead. Among these examples, ferrite is preferred.

Further, the carrier can be a resin-coated carrier in which the magnetic particles are coated with resin, or a dispersed-in-resin carrier in which the magnetic particles are dispersed in resin. The resin for coating the magnetic particles includes, but is not particularly limited to, for example, an olefin-based resin, a styrene-based resin, a styrene-acrylic resin, a silicone-based resin, an ester-based resin, and a fluorine-containing polymer-based resin. The resin used for the dispersed-in-resin carrier includes, but is not particularly limited either to, for example, a styrene-acrylic resin, a polyester resin, a fluorine-based resin, and a phenol resin.

A shape of the carrier is preferably spherical or oblong. Further, the particle size of the carrier is not particularly limited, and in consideration of enhancement in image quality, it preferably falls in a range of 10 μm or more and 100 μm or less, and more preferably 20 μm or more and 50 μm or less.

Furthermore, volume resistivity of the carrier is preferably $10^8$ Ω·cm or more, and more preferably $10^{12}$ Ω·cm or more. The resistivity of the carrier is a value derived from a current value obtained in a manner that the carrier is put in a container having a sectional area of 0.50 $cm^2$ followed by tapping, and a load of 1 $kg/cm^2$ is then applied to the particles put in the container by means of a weight, thereafter being subjected to application of voltage which generates an electric field of 1,000 V/cm between the weight and a bottom electrode. When the resistivity of the carrier is small, application of bias voltage to a developing sleeve will cause the charge to be injected to the carrier, which makes the carrier particles be easily attached to the photoreceptor. Further, in this case, breakdown of the bias voltage occurs more easily.

Magnetization intensity (maximum magnetization) of the carrier preferably falls in a range of 10 emu/g or more and 60 emu/g or less, and more preferably 15 emu/g or more and 40 emu/g or less. The magnetization intensity depends on magnetic flux density of the developing roller. Under a condition that the developing roller has normal magnetic flux density, the magnetization intensity less than 10 emu/g will lead to a failure to exercise magnetic binding force, which may cause the carrier to be spattered. When the magnetization intensity exceeds 60 emu/g, it becomes difficult to keep a noncontact state with an image bearing member in a noncontact development where brush of the carrier is too high, and in a contact development, sweeping patterns may appear more frequently in a toner image.

A use ratio between the toner and the carrier contained in the two-component developer is nor particularly limited and may be appropriately selected according to kinds of the toner and the carrier. To take the case of the resin-coated carrier (having density of 5 $g/cm^2$ to 8 $g/cm^2$) as an example, it is preferable to use the toner in such an amount that the content of the toner in the two-component developer falls in a range of 2% by weight or more and 30% by weight or less and preferably 2% by weight or more and 20% by weight or less, of a total amount of the two-component developer. Further, in the two-component developer, the coverage of the toner over the carrier preferably falls in a range of 40% or more and 80% or less.

FIG. 1 is a schematic view showing the constitution of an image forming apparatus 100 in accordance with one embodiment of the invention. The image forming apparatus 100 is a multifunctional peripheral having a copier function, a printer function, and a facsimile function together, and according to image information being conveyed to the image forming apparatus, a full-color or monochrome image is formed on a recording medium. That is, the image forming apparatus has three types of print mode, i.e., a copier mode, a printer mode and a FAX mode, and the print mode is selected by a control unit (not shown) in accordance with, for example, the operation input from an operation portion (not shown) and reception of the printing job from external equipment such as a personal computer, a mobile device, an information recording storage medium, and a memory device.

The image forming apparatus 100 includes the photoreceptor drum 11 acting as an image carrier, an image forming section 2, a transferring section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the image forming section 2 and some parts of the components contained in the transferring section 3. The four sets of respective components provided for the respective colors are distinguished herein by giving alphabets indicating the respective colors to the end of the reference numerals, and in the case where the sets are collectively referred to, only the reference numerals are shown.

The image forming section 2 includes a charging section 12, an exposure unit 13, a developing device 14, and a cleaning unit 15. The charging section 12 and the exposure unit 13 function as the latent-image forming section. The charging section 12, the developing device 14, and the cleaning unit 15 are disposed around the photoreceptor drum 11 in the order just stated. The charging section 12 is disposed vertically below the developing device 14 and the cleaning unit 1D.

The photoreceptor drum 11 is a roller-shaped member disposed so that it can be driven to rotate about its axis by a rotary driving section. On the surface area of the photoreceptor drum 11 is formed an electrostatic latent image. The rotary driving section for the photoreceptor drum 11 is controlled by a control unit which is realized by using a central processing unit (CPU). The photoreceptor drum 11 includes a conductive substrate (not shown) and a photosensitive layer (not shown) formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing at least conductive particles and/or conductive polymers. As the film-like substrate used for the conductive film, a synthetic resin Film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer can have a smooth surface, that chargeability of the photosensitive layer can be prevented from degrading during repetitive use, and that the charging property of the photosensitive layer can be enhanced under a low temperature circumstance and/or a low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charge under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styryistilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably falls in a range of 5 parts by weight or more and 500 parts by weight or less, and more preferably 10 parts by weight or more and 200 parts by weight or less with respect to 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resins may be used each alone or, optionally, two or more of them may be used in combination.

The charge generating layer can be formed by dissolving or dispersing an appropriate amount of a charge generating substance, a binder resin and, optionally, a plasticizer, a sensitizer, etc. respectively in an appropriate organic solvent in which the ingredients described above are dissolvable or dispersible, to thereby prepare a coating solution for charge generating layers and then applying the coating solution for charge generating layer to the surface of the conductive substrate, followed by drying. The thickness of the charge generating layer obtained in this way is not particularly limited, and preferably falls in a range of 0.05 μm or more and 5 μm or less, and more preferably 0.1 μm or more and 2.5 μm or less.

The charge transporting layer stacked over the charge generating layer contains as essential ingredients a charge transporting substance having an ability of receiving and transporting the charge generated from the charge generating substance, and a binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an Imidazole derivative, 9-(p-diethylaminostyryl)anthracene, 1,1-bis(4-dibenzylaminophenyl) propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably falls in a range of 10 parts by weight or more and 300 parts by weight or less, and more preferably 30 parts by weight or more and 150 parts by weight or less with respect to 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, an epoxy resin, polyurethane, polyvinylketone, polystyrene, polyacrylamide, a phenolic resin, a phenoxy resin, a polysulfone resin, and a copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane, and derivatives thereof, an organic sulfur compound, and an organic phosphorus compound. The antioxidants may be used each alone, or two or more of them may be used in combination. The content of the antioxidant is not particularly limited, and falls in a range 0.01% by weight or more 10% by weight or less, and preferably 0.05% by weight or more and 5% by weight or less, of the total amount of the ingredients constituting the charge transporting layer.

The charge transporting layer can be formed by dissolving or dispersing an appropriate amount of a charge transporting substance, a binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably falls in a range of 10 μm or more and 50 μm or less, and more preferably 15 μm or more and 40 μm or less.

It is also possible to form a photosensitive layer in which a charge generating substance and a charge transporting substance are present in one layer. In this case, the kinds and contents of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 when viewed in a longitudinal direction of the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum 12. It is also possible to use a contact-charging type charger such as a charging brush or a magnetic brush.

The exposure unit 13 is disposed so that light beams corresponding to each color information emitted from the exposure unit 13 pass between the charging section 2 and the developing device 14 and reach the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array and a unit in which a liquid-crystal shutter and a light source are appropriately combined with each other.

The cleaning unit 15 removes the toner which remains on the surface of the photoreceptor drum 11 after the toner image formed on the surface of the photoreceptor drum 11 has been transferred onto the recording medium by the developing device 14, and thus cleans the surface of the photoreceptor drum 11. In the cleaning unlit 15, a platy member is used such as a cleaning blade. In the image forming apparatus of the embodiment, an organic photoreceptor drum is mainly used as the photoreceptor drum 11. A surface of the organic photoreceptor drum contains a resin component as a main ingredient and therefore tends to be degraded by chemical action of ozone which is generated by corona discharging of a charging device. The degraded surface part is, however, worn away by abrasion through the cleaning unit 15 and thus removed reliably, though gradually. Accordingly, the problem of the surface degradation caused by the ozone, etc. is actually solved, and the potential of charge given in the charging operation can be thus maintained stably for a long period of time. Although the cleaning unit 15 is provided in the embodiment, no limitation is imposed on the configuration and the cleaning unit 15 does not have to be provided.

In the image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of the toner image forming operations just described is repeatedly carried out.

The transferring section 3 is disposed above the photoreceptor drum 11 and includes the intermediate transfer belt 25, a driving roller 26, a driven roller 27, four pieces of intermediate transferring rollers 28 corresponding to four colors: black; cyan; magenta; and yellow, respectively, a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. The driving roller 26 can rotate around an axis thereof with the aid of a driving section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a driving section (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multi-color image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 across the intermediate transfer belt 25 so as to come into contact with an outer circumferential surface of the intermediate transfer belt 25. The residual toner which is attached to the intermediate transfer belt 25, which is caused by contact of the intermediate transfer belt 25 with the photoreceptor drum 11, may cause contamination on a reverse side of the recording medium, the transfer belt cleaning unit 29 removes and collects the toner on the surface of the intermediate transfer belt 25.

The transferring roller 30 is disposed in pressure-contact with the driving roller 26 across the intermediate transfer belt 25, and capable of rotating around its own axis by a driving section (not shown). In a pressures contact portion between the transferring roller 30 and the driving roller 26, that is, a transfer nip portion, a toner image which has been carried by the intermediate transfer belt 25 and thereby conveyed to the pressure-contact portion is transferred onto a recording medium fed from the later-described recording medium feeding section 5. The recording medium bearing the toner image is fed to the fixing section 4.

In the transferring section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a driving section (not shown), and fixes on the recording medium an unfixed toner image borne on the recording medium by heating and fusing a toner constituting the unfixed toner image. Inside the fixing roller 31 is provided a heating portion (not shown). The heating portion heats the heating roller 31 so that a surface of the heating roller 31 has a predetermined temperature (hereinafter occasionally referred to as "heating temperature"). For the heating portion, a heater, a halogen lamp, and the like device can be used, for example. The heating portion is controlled by a fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotatably driven by the rotation of the fixing roller 31. The pressure roller 32 helps the toner image to be fixed onto the recording medium by pressing the toner and the recording medium when the toner is fused to be fixed on the recording medium by the fixing roller 31. A pressure-contact portion between the fixing roller 31 and the pressure roller 32 is a fixing nip portion.

In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 36, and a manual paper feed tray 39. The automatic paper feed tray 35 is disposed in a vertically lower part of the image forming apparatus and in form of a container-shaped member for storing the recording mediums. Examples of the recording medium include plain paper, color copy paper, sheets for overhead projector, and postcards. The pickup roller 36 takes out sheet by sheet the recording mediums stored to the automatic paper feed tray 35, and feeds the recording mediums to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image borne on the intermediate transfer belt 25 to the transfer nip portion. The manual paper feed tray 39 is a device storing recording mediums which are different from the recording mediums stored in the automatic paper feed tray 35 and may have any size and which are to be taken into the image forming apparatus, and the recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image borne on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image information obtained from external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus 100. Examples of the external equipment include a computer, a digital camera, a television, a video recorder, a DVD recorder, an HDDVD, a blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit (abbreviated as CPU). The control unit contains a main power source as well as the above-stated processing circuit. The power source supplies electricity to not only the control unit but also respective devices provided inside the image forming apparatus 100.

Figure 2:
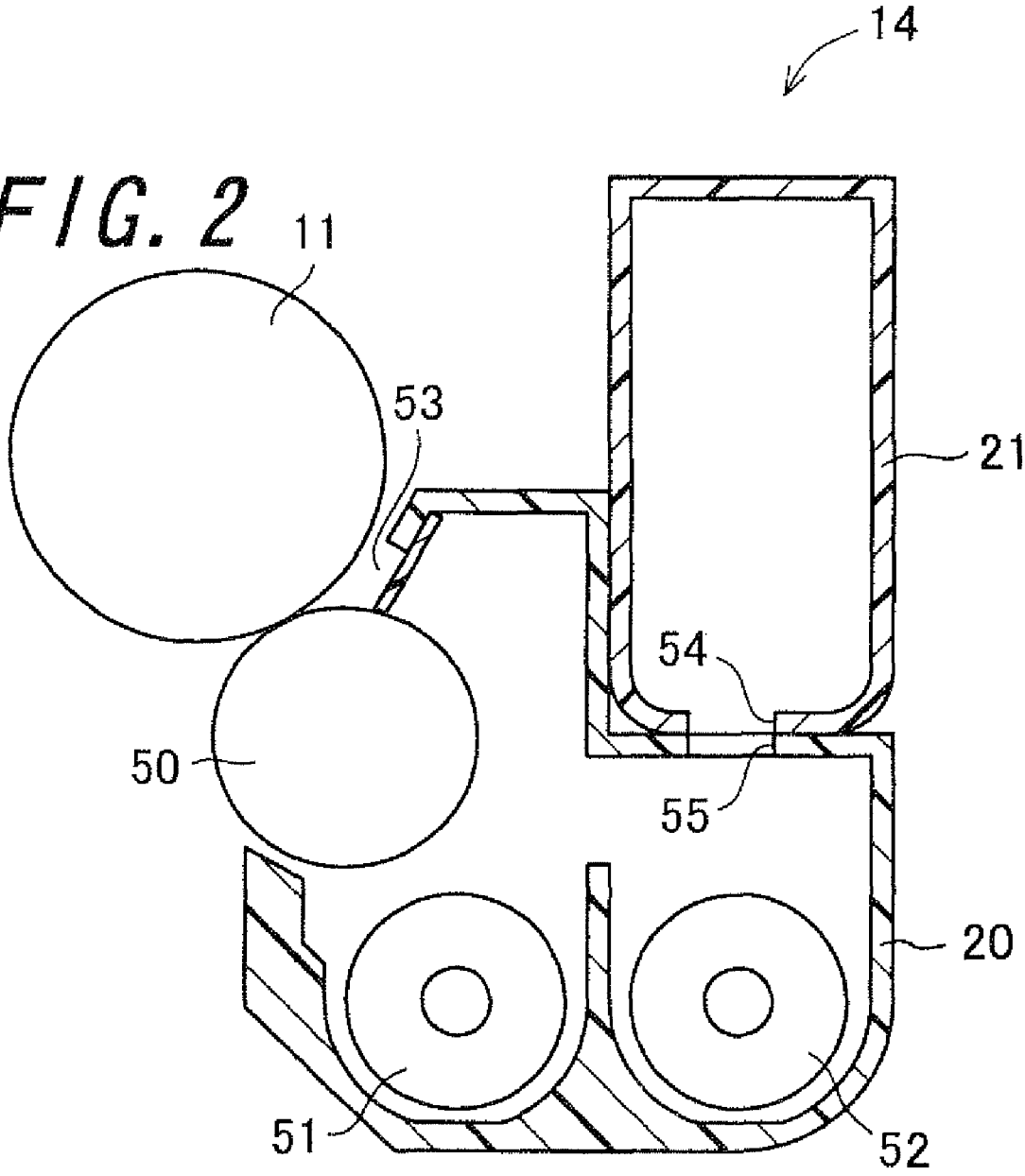
FIG. 2 is a schematic view showing a developing device mounted in the image forming apparatus shown in FIG. 1.

FIG. 2 is a schematic view showing the developing device 14 mounted in the image forming apparatus 100 shown in FIG. 1. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 50, a supplying roller 51, and an agitating roller 52, which are contained in the developing tank 20. Moreover, screw members may be contained therein instead of the roller members. In the developing device 14 of this embodiment, as the toner, the toner of the preceding embodiment is contained in the developer tank 20.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact portion or most-adjacent portion between the developing roller and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image, that is, a toner attachment amount to the electrostatic latent image can be controlled by changing a value of the development bias voltage.

The supplying roller 51 is a roller-shaped member which is rotatably disposed so as to face the developing roller 50 and used to supply the toner to the vicinity of the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 formed in a vertically lower part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As described heretofore, it is preferable that the developing device effects development by using the color toner of the invention. The color toner of the invention is capable of maintaining the transparency of a fixed toner layer even with the external addition of an external additive, and thus enables formation of toner images having uniform image density with stability. Moreover, the color toner of the invention is capable of controlling the amount of charge and preventing occurrence of fogging and toner scattering, and thus enables formation of good toner images with stability.

Further, it is preferable to realize an image forming apparatus with the provision of the developing device of the invention that is capable of forming toner images white preventing occurrence of fogging in image carrier. By effecting image formation with such an image forming apparatus, it is possible to form images having uniform image density for a longer period of time from the start of operation, as well as to attain enhanced color reproducibility in the formed image.

EXAMPLES

Hereinafter, the invention will be described in detail by way of examples and comparative examples.

In the examples and comparative examples, the average primary particle size of zinc oxide particles, the average particle size of primary-particle aggregates of zinc oxide particles, the volume resistivity of zinc oxide particles, the specific surface area of zinc oxide particles, and the volume average particle size of toner base particles were measured as follows.

[Average Primary Particle Size of Zinc Oxide Particles and Average Particle Size of Primary-Particle Aggregates of Zinc Oxide Particles]

With use of Scanning Electron Microscope S-4300SE/N (product name) manufactured by Hitachi High-Technologies Corporation, images of the particle size of primary particles of zinc oxide particles and the particle size of primary-particle aggregates of zinc oxide particles were taken under conditions where a magnification is 50000 times, changes are made to the field of view of the scanning electron microscope, and the number of target particles is 100. Then, through image analysts, the particle size of primary particles of zinc oxide particles and the particle size of primary-particle aggregates of zinc oxide particles were measured. On the basis of the measurement values, the average primary particle size of zinc oxide particles and the average particle size of primary-particle aggregates of zinc oxide particles were obtained by calculation.

[Volume Resistivity of Zinc Oxide Particles]

The volume resistivity of zinc oxide particles was obtained as follows by using DIELECTRIC LOSS MEASUREMENT SYSTEM TYPE. TR-10C (product name) manufactured by Ando Electric Co., Ltd. As the oscillator, TYPE WBG-9 (product name) manufactured by Anduo Electric Co., Ltd. was used. As the balance-point detector, TYPE BDA-9 (product name) manufactured by Ando Electric Co., Ltd. was used. As the constant-temperature bath, TYPE TO-19 (product name) manufactured by Ando Electric Co., Ltd. was used. As the electrode for solid body, TYPE SE-70 (product name) manufactured by Ando Electric Co., Ltd. was used. The effective electrode area A in the electrode for solid body is approximately 2.83 (0.952 $\pi$) $cm^2$.

1 g of zinc oxide particles was shaped into a tablet for use as a measurement sample by a tablet forming machine. With use of this measurement sample, conductance measurement was carried out as follows. At first, as the zero-balance operation, conductance was set to a predetermined value. The value of conductance given at this time was defined as "Ro". Next, the formed measurement sample was placed at the center of the electrode for solid body and a guard electrode was placed thereon, so that the measurement sample can be held between the electrodes. Then, the frequency of the oscillator was set at 1 kHz and a voltage of 10 V was applied to the region between the electrodes. After a lapse of 15 minutes from the start of voltage application between the electrodes, conductance measurement was carried out. The value of conductance obtained by this measurement was defined as "R". Following the completion of the measurement, the thickness of the tablet was measured at five positions: the center and four circumferential points of the tablet. Then, a mean of the measured thickness values was obtained, and this mean value was defined as "Tx".

When volume resistivity of zinc oxide particles was defined as R", R" can be derived from the following expression:

$$R''=10A/(Gx\cdot Tx)$$

In the expression, Gx represents conductance, and it can be derived from the following expression:

$$Gx=\text{RATIO value}\times(R'-Ro)$$

"RATIO value" represents a constant determined for each measurement frequency on an individual basis at the time of measurement. Herein, the measurement frequency is 1 kHz, and the corresponding RATIO value is given as $1\times10^{-9}$.

[Specific Surface Area of Zinc Oxide Particles]

The specific surface area of zinc oxide particles was measured in accordance with the BET three-point method by using a specific surface area/pore-size distribution analyzer: NOVAe 4200 (product name) manufactured by Yuasa Tonics inc. According to the BET three-point method, a plot slope A was obtained on the basis of the amount of nitrogen adsorbed at three relative pressure points, and a specific surface area value was derived from a BET equation.

[Volume Average Particle Size of Toner Base Particles]

20 mg of toner base particles and 1 ml of sodium alkyl ether sulfate were added to 50 ml of electrolysis solution: ISOTON-II (product name) manufactured by Beckman Coulter, Inc. The resultant mixture has been subjected to dispersion process for 3 minutes at an ultrasonic frequency of 20 kHz by means of a supersonic disperser: UH-50 (product name) manufactured by SMT Co., Ltd. thereby to prepare a measurement sample. Then, under conditions of an aperture diameter of 100 μm and the number of particles to be measured is 50000 counts, measurement was conducted on the measurement sample by means of a particle size distribution measuring apparatus: MULTISIZER 3 (product name) manufactured by Beckman Coulter, Inc. On the basis of the volume particle size distribution of the sample particles, the volume average particle size of toner base particles was obtained. Moreover, a coefficient of variation of the toner was obtained by calculation on the basis of the volume average particle size of toner base particles and the standard deviation thereof in accordance with the following expression (1):

$$\text{(Coefficient of variation)}=\text{(Standard deviation)}/\text{(Volume average particle size)} \quad (1)$$

(Production of Toner Base Particles)

100 parts by weight of polyester resin (binder resin having a melting temperature of 110° C.) obtained through polycondensation of bisphenol A propylene oxide, terephthalic acid, and trimellitic acid anhydride used as monomeric substances, 5.0 parts by weight of C.I. pigment blue 15 (colorant), 2.0 parts by weight of zinc salicylic compound (charge controlling agent: BONTRON E84 (product name) manufactured by Orient Chemical Industries, Ltd.) and 4.5 parts by weight of paraffin wax (release agent) have been mixed evenly for, 10 minutes by HENSCHEL MIXER (product name) manufactured by Mitsui Mining Co., Ltd to obtain a mixture. The mixture was kneaded by a twin-screw extruder while being heated at 105° C. and subsequently cooled down to obtain a kneaded product. The resultant kneaded product was coarsely pulverized by a cutting mill and further pulverized by an ultrasonic jet mill for fine grinding, and then particle sizing was performed thereon by using a classifier in such a manner as to remove fine powder. In this way, the toner base particles were obtained.

(Production of Toner)

The toners of Examples 1 to 20 and Comparative examples 1 to 4 were produced by adding 1.0 part by weight of silica particles and zinc oxide particles A to T listed in Table 1, respectively, to the toner base particles obtained in the above-described manner, followed by mixing them by HENSCHEL MIXER (manufactured by Mitsui Mining Co., Ltd.).

TABLE 1

| | Average primary particle size (nm) | Volume resistivity (Ωcm) | Specific surface area ($m^2/g$) | Doping treatment type | Average particle size of primary-particle aggregates (μm) | Additive amount (parts by weight) |
|---|---|---|---|---|---|---|
| Zinc oxide particle A | 12 | $1.0\times10^5$ | 90 | Aluminum | 0.06 | 1.5 |
| Zinc oxide particle B | 25 | $1.0\times10^5$ | 50 | Aluminum | 0.08 | 1.5 |
| Zinc oxide particle C | 48 | $1.0\times10^5$ | 32 | Aluminum | 0.21 | 1.5 |
| Zinc oxide particle D | 25 | 510 | 50 | Aluminum | 0.09 | 1.5 |
| Zinc oxide particle E | 25 | 480 | 50 | Aluminum | 0.08 | 1.5 |
| Zinc oxide particle F | 25 | $1.0\times10^7$ | 50 | Aluminum | 0.09 | 1.5 |
| Zinc oxide particle G | 25 | $1.0\times10^6$ | 50 | Aluminum | 0.08 | 1.5 |
| Zinc oxide particle H | 40 | $1.0\times10^5$ | 31 | Aluminum | 0.07 | 1.5 |
| Zinc oxide particle I | 42 | $1.0\times10^5$ | 28 | Aluminum | 0.09 | 1.5 |
| Zinc oxide particle J | 15 | $1.0\times10^5$ | 98 | Aluminum | 0.08 | 1.5 |
| Zinc oxide particle K | 15 | $1.0\times10^5$ | 105 | Aluminum | 0.28 | 1.5 |
| Zinc oxide particle L | 25 | $1.0\times10^4$ | 40 | Antimony | 0.10 | 1.5 |
| Zinc oxide particle M | 25 | $1.0\times10^5$ | 50 | Aluminum | 0.21 | 3.0 |
| Zinc oxide particle N | 25 | $1.0\times10^5$ | 50 | Aluminum | 0.24 | 3.2 |
| Zinc oxide particle O | 25 | $1.0\times10^5$ | 50 | Aluminum | 0.07 | 0.05 |
| Zinc oxide particle P | 25 | $1.0\times10^5$ | 50 | Aluminum | 0.07 | 0.04 |
| Zinc oxide particle Q | 8 | $1.0\times10^6$ | 90 | Aluminum | 0.35 | 1.5 |
| Zinc oxide particle R | 55 | $1.0\times10^4$ | 30 | Aluminum | 0.15 | 1.5 |
| Zinc oxide particle S | 25 | $1.0\times10^5$ | 50 | Aluminum | 0.31 | 1.5 |
| Titanium oxide particle T | 25 | $1.0\times10^4$ | 60 | Not Doped | 0.15 | 1.5 |

Example 1

The toner of Example 1 was produced by adding 1.5 parts by weight of zinc oxide particles A listed in Table 1 and 1.0 part by weight of silica particles (RX-200 (product name) manufactured by Degussa Corporation) having an average primary particle size of 12 nm to 100 parts by weight of the toner base particles obtained in the above-described manner (volume average particle size: 6.2 μm), followed by mixing them by a HENSCHEL MIXER: Mitsui FM Mixer (product name) manufactured by Mitsui Mining Co., Ltd. In Example 1, the average particle size of primary-particle aggregates of zinc oxide particles was 0.06 μm.

Example 2

The toner of Example 2 was produced basically in the same mariner as in Example 1, except that zinc oxide particles B were used in lieu of zinc oxide particles A. In, Example 2, the average particle size of zinc oxide particles aggregated on the surfaces of the toner base particles was 0.08 μm.

Example 3

The toner of Example 3 was produced basically in the same manner as in Example 1, except that zinc oxide particles C were used in lieu of zinc oxide particles A. In Example 3, the average particle size of zinc oxide particles aggregated on the surfaces of the toner base particles was 0.21 μm.

Example 4

The toner of Example 4 was produced basically in the same manner as in Example 1, except that zinc oxide particles D were used in lieu of zinc oxide particles A. In Example 4, the average particle size of zinc oxide particles aggregated on the surfaces of the toner base particles was 0.69 μm.

Example 5

The toner of Example 5 was produced basically in the same manner as in Example 1, except that zinc oxide particles E were used in lieu of zinc oxide particles A. In Example 5, the average particle size of zinc oxide particles aggregated on the surfaces of the toner base particles was 0.08 μm.

Example 6

The toner of Example 6 was produced basically in the same manner as in Example 1, except that zinc oxide particles F were used in lieu of zinc oxide particles A. In Example 6, the average particle size of zinc oxide particles aggregated on the surfaces of the toner base particles was 0.09 μm.

Example 7

The toner of Example 7 was produced basically in the same manner as in Example 1, except that zinc oxide particles G were used in lieu of zinc oxide particles A. In Example 7, the average particle size of zinc oxide particles aggregated on the surfaces of the toner base particles was 0.08 μm.

Example 8

The toner of Example 2 was produced basically in the same manner as in example 1, except that zinc oxide particles H were used in lieu of zinc oxide particles A. In Example 8, the average particle size of zinc oxide particles aggregated on the surfaces of the toner base particles was 0.07 μm.

Example 9

The toner of Example 9 was produced basically in the same manner as in Example 1, except that zinc oxide particles I were used in lieu of zinc oxide particles A. In Example 9, the average particle size of zinc oxide particles aggregated on the surfaces of the toner base particles was 0.09 μm.

Example 10

The toner of Example 10 was produced basically in the same manner as in Example 1, except that zinc oxide particles J were used in lieu of zinc oxide particles A. In Example 10, the average particle size of zinc oxide particles aggregated on the surfaces of the toner base particles was 0.08 μm.

Example 11

The toner of Example 11 was produced basically in the same manner as in Example 1, except that zinc oxide particles K were used in lieu of zinc oxide particles A. In Example 11, the average particle size of zinc oxide particles aggregated on the surfaces of the toner base particles was 0.23 μm.

Example 12

The toner of Example 1-2 was produced basically in the same manner as in Example 1, except that zinc oxide particles L were used in lieu of zinc oxide particles A. In Example 12, the average particle size of zinc oxide particles aggregated on the surfaces of the toner base particles was 0.10 μm.

Example 13

The toner of Example 13 was produced basically in the same manner as in Example 1, except that zinc oxide particles M were used in lieu of zinc oxide particles A and the additive amount thereof was changed to 3.0 parts by weight. In Example 13, the average particle size of zinc oxide particles aggregated on the surfaces of the toner base particles was 0.21 μm.

Example 14

The toner of Example 14 was produced basically in the same manner as in Example 1, except that zinc oxide particles N were used in lieu of zinc oxide particles A and the additive amount thereof was changed to 3.2 parts by weight. In Example 14, the average particle size of zinc oxide particles aggregated on the surfaces of the toner base particles was 0.24 μm.

Example 15

The toner of Example 15 was produced basically in the same manner as in Example 1, except that zinc oxide particles C were used in lieu of zinc oxide particles A and the additive amount thereof was changed to 0.05 parts by weight. In Example 15, the average particle size of zinc oxide particles aggregated on the surfaces of the toner base particles was 0.07 μm.

Example 16

The toner of Example 16 was produced basically in the same manner as in Example 1, except that zinc oxide particles P were used in lieu of zinc oxide particles A and the additive amount thereof was changed to 0.04 parts by weight. In Example 16, the average particle size of zinc oxide particles aggregated on the surfaces of the toner base particles is 0.07 μm.

Example 17

The toner of Example 17 was produced basically in the same manner as in Example 2, except that zinc oxide particles B were used in lieu of zinc oxide particles A and the volume average particle size of the toner base particles was changed to 4.29 μm. In Example 17, the average particle size of zinc oxide particles aggregated on the surfaces of the toner base particles was 0.08 μm.

Example 18

The toner of Example 18 was produced basically in the same manner as in Example 2, except that zinc oxide particles B were used in lieu of zinc oxide particles A and the volume average particle size of the toner base particles was changed to 3.9 μm. In Example 18, the average particle size of zinc oxide particles aggregated on the surfaces of the toner base particles was 0.08 μm.

Example 19

The toner of Example 19 was produced basically in the same manner as in Example 2, except that zinc oxide particles B were used in lieu of zinc oxide particles A and the volume average particle size of the toner base particles was changed to 7.9 μm. In Example 19, the average particle size of zinc oxide particles aggregated on the surfaces of the toner base particles was 0.08 μm.

Example 20

The toner of Example 20 was produced basically in the same manner as in Example 2, except that zinc oxide particles B were used in lieu of zinc oxide particles A and the volume average particle size of the toner base particles was changed to 8.2 μm. In Example 20, the average particle size of zinc oxide particles aggregated on the surfaces of the toner base particles was 0.08 μm.

Comparative Example 1

The toner of Comparative Example 1 was produced basically in the same manner as in Example 1, except that zinc oxide particles Q were used in lieu of zinc oxide particles A. In Comparative Example 1, the average particle size of zinc oxide particles aggregated on the surfaces of the toner base particles was 0.35 μm.

Comparative Example 2

The toner of Comparative Example 2 was produced basically in the same manner as in Example 1, except that zinc oxide particles R were used in lieu of zinc oxide particles A. In Comparative Example 2, the average particle size of zinc oxide particles aggregated on the surfaces of the toner base particles was 0.15 μm.

Comparative Example 3

The toner of Comparative Example 3 was produced basically in the same manner as in Example 1, except that zinc oxide particles S were used in lieu of zinc oxide particles A and the condition for agitation by the HENSCHEL MIXER (manufactured by Mitsui Mining Co., Ltd.) was changed. In Comparative Example 3, the average particle size of zinc oxide particles aggregated on the surfaces of the toner base particles was 0.31 μm.

Comparative Example 4

The toner of Comparative Example 4 was produced basically in the same manner as in Example 1, except that titanium oxide particles T were used in lieu of zinc oxide particles A. In Comparative Example 4, the average particle size of zinc oxide particles aggregated on the surfaces of the toner base particles was 0.15 μm.

Each of the toners of Examples 1 to 20 and Comparative examples 1 to 4 and ferritic core carrier having a volume average particle size of 45 μm was mixed for 20 minutes by a V-type mixer MODEL V-5 (product name) manufactured by Tokuju Corporation in such a manner that the coverage of toner with respect to the carrier is 60%. In this way, two-component type developers were formed.

The evaluation of each of the two-component type developers formed based on the examples and comparative examples was conducted by the following method in terms of transparency, thin-line reproducibility, image-density uniformity, background fogging, and the amount of charge.

As the evaluation machine, Color Copier: MX-2700 (product name) manufactured by Sharp Corporation was used. Note that "initial evaluation" means that subsequently-described evaluation steps are conducted after charging the toner into an empty toner cartridge, and "after-10000 copies evaluation" means that the subsequently-described evaluation steps are conducted after producing 10000 sheets of copies by the evaluation machine.

[Transparency]

For the initial evaluation, a 3 cm-by-3 cm solid image was printed on an OHP sheet, with the adherent toner amount on the OHP sheet adjusted to be 0.5 mg/cm$^2$, by the evaluation machine. After that, the light transmittance of the fixed toner layer of the solid image was measured at a wavelength of 470 nm by a spectrophotometer: U-3300 (product name) manufactured by Hitachi, Ltd. Then, a comparison was made between the case where the toner was externally added with an external additive and the case where the toner is tree of an external additive to obtain the rate of decrease in light transmittance. The criteria for the light transmittance-based transparency evaluation are as follows.

Good: Light transmittance decrease rate is less than 10%

Mediocre: Light transmittance decrease rate is greater than or equal to 10% but less than 20%

Poor: Light transmittance decrease rate is greater than or equal to 20%

[Thin-Line Reproducibility]

For the initial evaluation, under a condition where a half-tone image which is 0.3 in image density and 5 mm in diameter can be duplicated at image density which is 0.3 or more and 0.5 or less, a document on which is formed a thin-line original image, the line width of which is exactly 100 μm, was duplicated by the evaluation machine. The resultant copy image was used as a measurement sample. The measurement sample was taken into a particle analyzer: LUZEX 450 (product name) manufactured by NIRECO Corporation to be magnified at a magnification of 100 times. On the basis of the resultant monitored image, the line width of the lines formed on the measurement sample was measured by an indicator. The image density refers to optical reflection density measured by a reflection densitometer: RD-918 (product name) manufactured by Macbeth Corporation. Since the thin lines have irregularities and the line width varies according to measurement positions, the measurement of line width was conducted at a plurality of positions to obtain a mean value. The line width corresponding to the mean value was defined as the line width of the measurement sample. Then, the line width of the measurement sample was divided by 100 μm which is the line width of the manuscript. A value obtained by multiplying the division result by 100 was defined as the value of thin-line reproducibility. The more the value is close to 100, the better the thin-line reproducibility becomes, which leads to excellent resolution property. The criteria for the evaluation are as follows.

Good: Thin-line reproducibility value is greater than or equal to 100 but less than 115

Mediocre: Thin-line reproducibility value is greater than or equal to 115 but less than 125

Poor: Thin-Line reproducibility value is greater than or equal to 125

[Image-Density Uniformity]

For the Initial evaluation, as well as for the after-10000 copies evaluation, the image-density uniformity was evaluated by using the evaluation machine. At first, a 3 cm-by-3 cm solid image was printed on a transfer paper sheet. Then, three positions, namely the center and the opposite ends of the solid image were subjected to measurement in the reflection densitometer RD-918 (manufactured by Macbeth Corporation). Among the measured reflection density values, the highest reflection density and the lowest reflection density were compared and the difference between them was defined as the density difference. On the basis of the following criteria, the image-density uniformity was evaluated.

Good: Density difference is less than or equal to 0.15

Mediocre: Density difference is greater than 0.15 but less than or equal to 0.25

Poor: Density difference exceeds 0.25

[Background Fogging]

For the initial evaluation, as well as for the after-10000 copies evaluation, the background fogging was evaluated by using the evaluation machine. The reflection density of the white background area of transfer paper was measured by the reflection densitometer RD-918 (manufactured by Macbeth Corporation) before and after an image is printed on the transfer paper, and the difference between the before-printing reflection density and the after-printing reflection density was derived. The criteria for the evaluation are as follows.

Good: Reflection density difference is less than or equal to 0.005

Mediocre: Reflection density difference is greater than 0.005 but less than 0.009

Poor: Reflection density difference is greater than 0.009

[Amount of Charge]

For the initial evaluation, as well as for the after-10000 copies evaluation, the amount of charge applied to the toner was measured by using a charge measurement apparatus: Model 210HS-2A (product name) manufactured by TREK JAPAN KK in the following manner. The two-component developer scooped up from within the bail mill was put in a metal-made container having a 500-mesh conductive screen attached to the bottom thereof. Then, only the toner component was sucked by a suction unit at a suction pressure of 250 mmHg. On the basis of the difference between the weight of the mixture measured before the suction and that measured at ter the suction, and the difference in potential between the capacitor polar plates connected to the container, the amount of charge allied to the toner was obtained.

[Comprehensive Evaluation]

The criteria for the comprehensive evaluation are as follows:

Excellent: There is neither "Mediocre" nor "Poor" in every evaluation result.

Good: There is "Mediocre" in some evaluation results but "Poor" does not exist.

Poor: There is "Poor" at least in one evaluation result.

Table 2 shows the evaluation results and comprehensive evaluation results of toners obtained in the above examples and comparative examples.

TABLE 2

| | | Volume average particle size of toner base particles (μm) | Transparency | | Thin-line reproducibility | | Initial evaluation | | |
|---|---|---|---|---|---|---|---|---|---|
| | | | Decrease rate (%) | Evaluation | Thin-line reproducibility value | Evaluation | Charge amount (μC/g) | Toner density uniformity Density difference | Toner density uniformity Evaluation |
| Ex. 1 | Zinc oxide particle A | 6.2 | 5 | Good | 107 | Good | −28 | 0.10 | Good |
| Ex. 2 | Zinc oxide particle B | 6.2 | 8 | Good | 108 | Good | −27 | 0.11 | Good |
| Ex. 3 | Zinc oxide particle C | 6.2 | 13 | Mediocre | 106 | Good | −25 | 0.12 | Good |
| Ex. 4 | Zinc oxide particle D | 6.2 | 7 | Good | 105 | Good | −24 | 0.13 | Good |
| Ex. 5 | Zinc oxide particle E | 6.2 | 8 | Good | 110 | Good | −21 | 0.15 | Good |
| Ex. 6 | Zinc oxide particle F | 6.2 | 7 | Good | 104 | Good | −30 | 0.05 | Good |
| Ex. 7 | Zinc oxide particle G | 6.2 | 7 | Good | 105 | Good | −33 | 0.19 | Mediocre |
| Ex. 8 | Zinc oxide particle H | 6.2 | 8 | Good | 106 | Good | −30 | 0.05 | Good |
| Ex. 9 | Zinc oxide particle I | 6.2 | 7 | Good | 105 | Good | −29 | 0.08 | Good |
| Ex. 10 | Zinc oxide particle J | 6.2 | 8 | Good | 108 | Good | −25 | 0.14 | Good |
| Ex. 11 | Zinc oxide particle K | 6.2 | 15 | Mediocre | 111 | Good | −24 | 0.13 | Good |
| Ex. 12 | Zinc oxide particle L | 6.2 | 18 | Mediocre | 112 | Good | −25 | 0.11 | Good |
| Ex. 13 | Zinc oxide particle M | 6.2 | 9 | Good | 111 | Good | −24 | 0.12 | Good |
| Ex. 14 | Zinc oxide particle N | 6.2 | 12 | Mediocre | 112 | Good | −23 | 0.14 | Good |
| Ex. 15 | Zinc oxide particle O | 6.2 | 6 | Good | 106 | Good | −29 | 0.10 | Good |
| Ex. 16 | Zinc oxide particle P | 6.2 | 7 | Good | 105 | Good | −33 | 0.09 | Good |

TABLE 2-continued

| | | | | | | | | | |
|---|---|---|---|---|---|---|---|---|---|
| Ex. 17 | Zinc oxide particle B | 4.2 | 8 | Good | 106 | Good | −30 | 0.08 | Good |
| Ex. 18 | Zinc oxide particle B | 3.9 | 7 | Good | 107 | Good | −31 | 0.14 | Good |
| Ex. 19 | Zinc oxide particle B | 7.9 | 8 | Good | 114 | Good | −24 | 0.14 | Good |
| Ex. 20 | Zinc oxide particle B | 8.2 | 8 | Good | 118 | Mediocre | −23 | 0.15 | Good |
| Comp. Ex. 1 | Zinc oxide particle Q | 6.2 | 30 | Poor | 112 | Good | −21 | 0.21 | Mediocre |
| Comp. Ex. 2 | Zinc oxide particle R | 6.2 | 9 | Good | 105 | Good | −30 | 0.22 | Mediocre |
| Comp. Ex. 3 | Zinc oxide particle S | 6.2 | 25 | Poor | 110 | Good | −25 | 0.19 | Mediocre |
| Comp. Ex. 4 | Titanium oxide particle T | 6.2 | 24 | Poor | 109 | Good | −29 | 0.08 | Good |

| | | Initial evaluation | | After-10000 copies evaluation | | | | | |
|---|---|---|---|---|---|---|---|---|---|
| | | Background fogging | | | Toner density uniformity | | Background fogging | | |
| | | Reflection density difference | Evaluation | Charge amount (μC/g) | Density difference | Evaluation | Reflection density difference | Evaluation | Comprehensive Evaluation |
| Ex. 1 | Zinc oxide particle A | 0.002 | Good | −29 | 0.09 | Good | 0.001 | Good | Excellent |
| Ex. 2 | Zinc oxide particle B | 0.002 | Good | −28 | 0.12 | Good | 0.002 | Good | Excellent |
| Ex. 3 | Zinc oxide particle C | 0.003 | Good | −24 | 0.11 | Good | 0.003 | Good | Good |
| Ex. 4 | Zinc oxide particle D | 0.004 | Good | −23 | 0.14 | Good | 0.003 | Good | Excellent |
| Ex. 5 | Zinc oxide particle E | 0.008 | Mediocre | −20 | 0.15 | Good | 0.008 | Mediocre | Good |
| Ex. 6 | Zinc oxide particle F | 0.002 | Good | −28 | 0.07 | Good | 0.004 | Good | Excellent |
| Ex. 7 | Zinc oxide particle G | 0.001 | Good | −35 | 0.20 | Mediocre | 0.008 | Mediocre | Good |
| Ex. 8 | Zinc oxide particle H | 0.002 | Good | −28 | 0.10 | Good | 0.002 | Good | Excellent |
| Ex. 9 | Zinc oxide particle I | 0.002 | Good | −22 | 0.18 | Mediocre | 0.007 | Mediocre | Good |
| Ex. 10 | Zinc oxide particle J | 0.003 | Good | −23 | 0.14 | Good | 0.003 | Good | Excellent |
| Ex. 11 | Zinc oxide particle K | 0.004 | Good | −22 | 0.20 | Mediocre | 0.004 | Good | Good |
| Ex. 12 | Zinc oxide particle L | 0.003 | Good | −26 | 0.12 | Good | 0.004 | Good | Good |
| Ex. 13 | Zinc oxide particle M | 0.003 | Good | −23 | 0.14 | Good | 0.003 | Good | Excellent |
| Ex. 14 | Zinc oxide particle N | 0.004 | Good | −22 | 0.15 | Good | 0.004 | Good | Good |
| Ex. 15 | Zinc oxide particle O | 0.002 | Good | −30 | 0.10 | Good | 0.003 | Good | Excellent |
| Ex. 16 | Zinc oxide particle P | 0.001 | Good | −34 | 0.20 | Mediocre | 0.007 | Mediocre | Good |
| Ex. 17 | Zinc oxide particle B | 0.002 | Good | −31 | 0.09 | Good | 0.004 | Good | Excellent |
| Ex. 18 | Zinc oxide particle B | 0.008 | Mediocre | −25 | 0.21 | Mediocre | 0.008 | Mediocre | Good |
| Ex. 19 | Zinc oxide particle B | 0.004 | Good | −23 | 0.13 | Good | 0.004 | Good | Excellent |
| Ex. 20 | Zinc oxide particle B | 0.003 | Good | −21 | 0.12 | Good | 0.002 | Good | Good |
| Comp. Ex. 1 | Zinc oxide particle Q | 0.008 | Mediocre | −20 | 0.31 | Poor | 0.007 | Mediocre | Poor |
| Comp. Ex. 2 | Zinc oxide particle R | 0.009 | Mediocre | −36 | 0.35 | Poor | 0.016 | Poor | Poor |
| Comp. Ex. 3 | Zinc oxide particle S | 0.004 | Good | −24 | 0.23 | Mediocre | 0.008 | Mediocre | Poor |
| Comp. Ex. 4 | Titanium oxide particle T | 0.003 | Good | −28 | 0.09 | Good | 0.004 | Good | Poor |

As will be understood from the foregoing, by using the color toner of the invention, it is possible to form images having uniform image density with stability for a longer period of Lime from the start of operation, and it will be apparent that color fixed images exhibiting excellent color reproducibility can be produced.

The color toner adopted in this embodiment was illustrated as a cyan toner. This is because the colorant contained in the toner is Pigment Blue 15 used for representation of cyan. However, instead of the colorant, any of various colorants as described hereinabove may be contained in the same manner to constitute the color toner.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A color toner comprising:

toner base particles containing binder resin and colorant, surfaces of which are externally added with zinc oxide particles, the zinc oxide particles being such that an average particle size of their primary particles falls in a range of 10 nm or more and 50 nm or less, an average particle size of their primary-particle aggregates is 0.3 μm or less, the zinc oxide particle is made of zinc oxide doped with aluminum, and the zinc oxide particles have a volume resistivity falling in the range of 500 Ωcm or more and $10^7$ Ωcm or less.

2. The color toner of claim 1, wherein a specific surface area of the zinc oxide particles falls in a range of 30 $m^2/g$ or more and 100 $m^2/g$ or less.

3. The color toner of claim 1, wherein a content of the zinc oxide particles falls in a range of 0.05 parts by weight or more and 3.0 parts by weight or less with respect to 100 parts by weight of the toner base particles.

4. The color toner of claim 1, wherein a volume average particle size of the toner base particles falls in a range of 4.0 μm or more and 8.0 μm or less.

5. A developer containing the color toner of claim 1.

* * * * *